United States Patent [19]

Guillaumont

[11] 4,427,521

[45] Jan. 24, 1984

[54] CATHODE ASSEMBLY FOR AN ELECTROLYTIC CELL

[75] Inventor: Jacques Guillaumont, Saint-Auban, France

[73] Assignee: Chloe Chimie, Puteaux, France

[21] Appl. No.: 363,787

[22] Filed: Mar. 31, 1982

[30] Foreign Application Priority Data

Apr. 10, 1981 [FR] France ..... 81 07196

[51] Int. Cl.[3] ..... C25B 9/04; C25B 13/02; C25B 11/03

[52] U.S. Cl. ..... 204/275; 204/284; 204/286; 204/288

[58] Field of Search ..... 204/288, 286, 284, 98, 204/275

[56] References Cited

U.S. PATENT DOCUMENTS 4,017,376 4/1977 Mose et al. ..... 204/288 X
4,059,500 11/1977 Kamarian ..... 204/288

*Primary Examiner*—G. L. Kaplan
*Assistant Examiner*—Nam X. Nguyen
*Attorney, Agent, or Firm*—Burns, Doane, Swecker & Mathis

[57] ABSTRACT

A cathode assembly for an electrolytic cell, which assembly being especially adapted for diaphragm or membranous electrolytic cells, is comprised of a reinforced internal cathode including fingerlike lateral extensions, such reinforcement comprising vertical and horizontal flat metal strips, and said assembly including electrical and mechanical connections to an external current source and being characterized by reduced electrical resistance and capacity for ready assembly of the internal cathode.

10 Claims, 10 Drawing Figures

Fig. 1
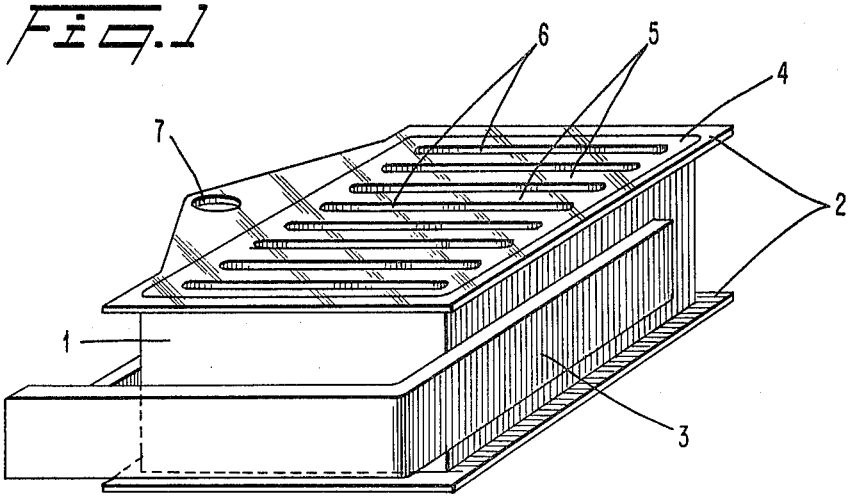
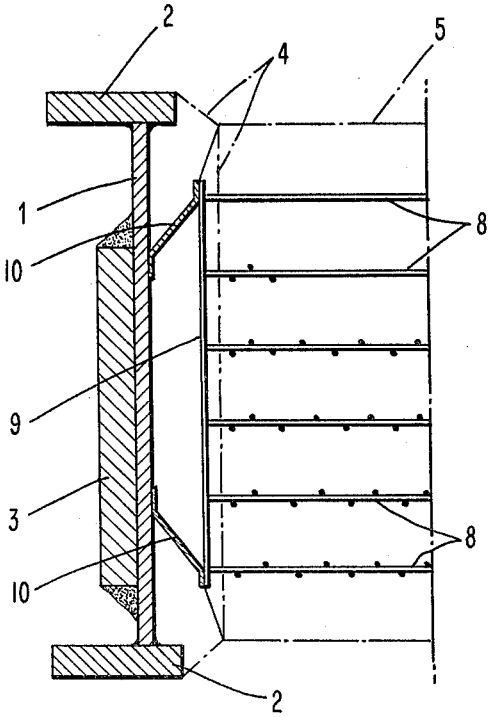
Fig. 2
Fig. 3
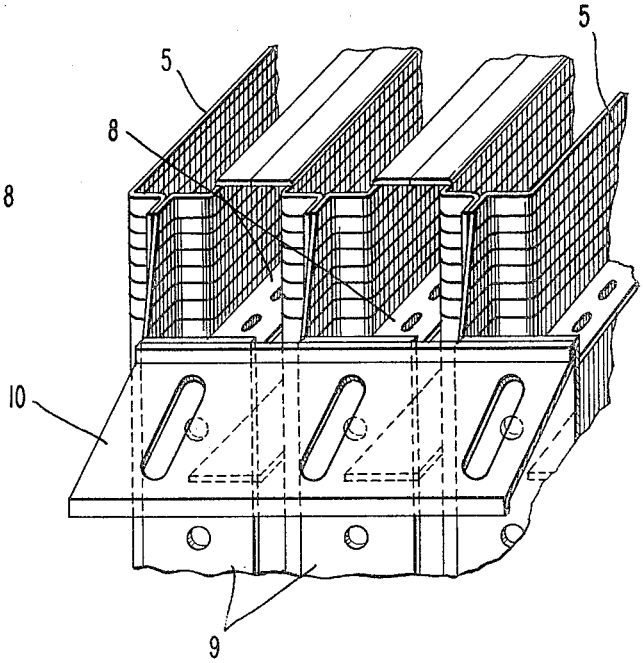

Fig. 8
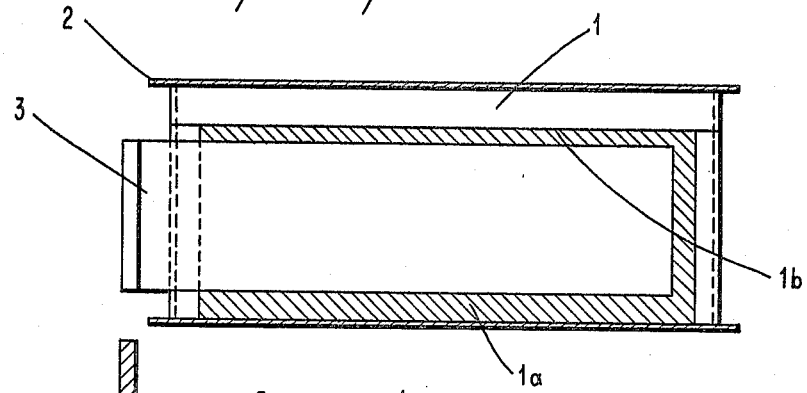
Fig. 9
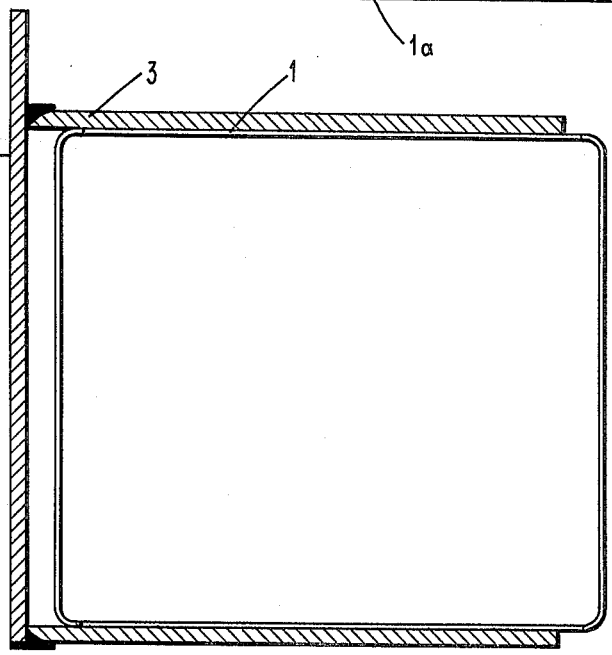
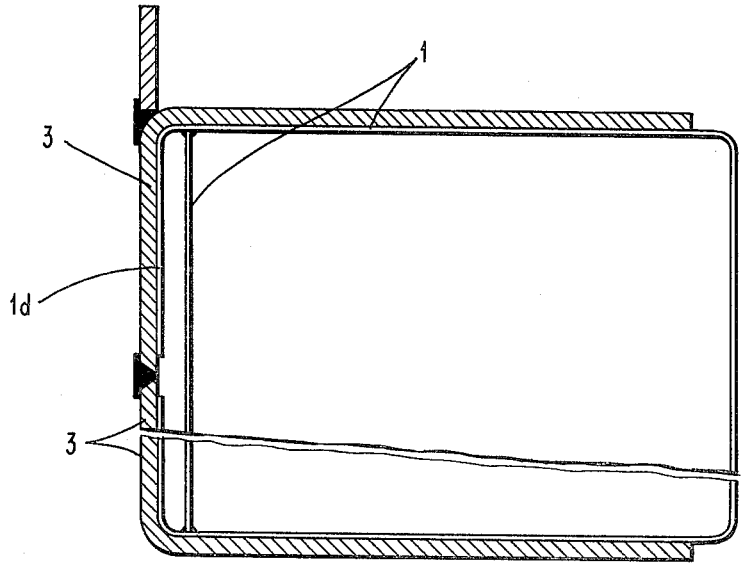
Fig. 10

CATHODE ASSEMBLY FOR AN ELECTROLYTIC CELL

BACKGROUND OF THE INVENTION

1. Field of the Invention

The present invention relates to an improved cathode having lateral extensions of "glove fingers" type, and, more especially, to such cathode for an electrolysis cell, the electrical conductivity of which, in particular, is markedly improved.

2. Description of the Prior Art

Cathodes "in the form of traversing or non-traversing glove fingers", depending upon whether they extend from one side of the cell to the other, or leave a passage between their respective inner ends for the circulation of the electrolyte, have been used for several decades for the electrolysis of alkali metal chlorides, and in particular for the preparation of chlorine and caustic soda. Such cathodes are charged with electric current via the vertical sidewalls of the cell and via a cathode band formed by a plate folded in the shape of a horseshoe, or by several plates of highly conductive metal, applied to the outside of one or more of said cell walls. This electric current can be homogeneously distributed inside the cells, and in particular over the cathode surfaces active in the electrolysis, opposite the anodes, by means of members having a minimum resistance.

It will also be appreciated that, in the chlorine industry, the term "cathode" frequently connotes not only the internal portion of the cell playing an active role in the discharge of the positive ions, but also the vertical sidewalls or enclosure of the cell and the cathode band, namely, the entire assembly which directs the current from the conductor connected to the negative source of current, generally via other cells, to the electrolyte. The term "cathode assembly" will be employed hereafter to connote the "cathode" in this broad sense, which therefore includes a portion inside the cell, which will be referred to as the "internal cathode" and is itself formed by a peripheral chamber in contact with the walls, with tubular extensions of rectangular cross-section, or fingers, in communication with the said chamber, and an external portion formed by the vertical sidewalls or enclosure of the cell and by the cathode band.

The internal cathode, which consists of perforated metal or, most frequently, of iron or steel mesh, generally supports the diaphragm, which is deposited by filtration, on the perforated metal serving as the filter, of a slurry containing the solid material of this separator, by means of a partial vacuum created inside the cathode. Asbestos fibers, which long have constituted the essential element of this material, are now augmented or even replaced by fluorinated resins, which require, after deposition, baking at a temperature which can be on the order of 400° C., in order to consolidate this diaphragm by sintering. The pressure which is exerted on the internal cathodes and the tensions generated by the heat treatment, in the case where these electrodes have a large surface area, frequently result in deformations and detract from their inherent flatness and from the parallelism of the active surfaces among themselves and with respect to the anodes.

To overcome these various noted disadvantages, it was necessary to arrange strengthening or reinforcing elements in the form of corrugated steel plates, inside the cathode fingers; these plates, on which the internal cathode is constructed, prevent the fingers from being crushed during the deposition of the diaphragm. An assembly of this type does not completely overcome the difficulties referred to above; furthermore, the contacts between these elements and the perforated walls of the internal cathode are point contacts and are frequently made via oxidized surfaces. Thus, they play virtually no role in the conduction of the currents, all the more so because the electrical and mechanical connections between the wall of the cell and the active part of the cathode are made essentially via the lower and upper perforated walls of the peripheral chamber.

French Pat. No. 2,287,527 proposes the use of spacers in the form of rectilinear plates with notched longitudinal edges. More precisely, the said patent recommends the use of spacers, the teeth of which have a cross-section in the shape of a rectangle, the sides of which are in one case larger and in another case smaller than the diameter of the perforated plates, the pitch of the teeth being different from that of the perforations in the perforated plates which form the box structure of the cathode elements (page 16, line 14, to page 17, line 2, of the above-mentioned patent).

SUMMARY OF THE INVENTION

Accordingly, a major object of the present invention is the provision of an improved cathode assembly, the assembling and dismantling of the internal workings of which being vastly facilitated, which is not subject to substantial deformations during the various treatments to which it may be subjected, which has a relatively low resistance to the flow of electric current, and which furthermore employs spacers which combine a considerable ease of construction with efficiency from mechanical and electrical points of view.

Briefly, the subject cathode assembly according to the invention features a vertical enclosure or housing which exteriorly comprises a cathode band, fabricated of metal which is a good conductor of electricity, and inside of which there is arranged a peripheral chamber in communicating relationship with internal extensions of substantially rectangular cross-section, the larger dimension of which being the vertical dimension, extending inside the cell, the said chamber and the said extensions, the walls of which are of perforated metal, being strengthened by a plurality of flat metal elements arranged horizontally within the said extensions and securedly fixed to vertical flat elements arranged in the peripheral chamber, these vertical flat elements themselves being secured to the vertical enclosure of the cell.

By the expression "perforated metal" as utilized herein, there is intended a discontinuous metal surface. Such expression applies in particular to meshes, perforated metal plates, expanded or foraminous metal and similar products.

The enclosure or housing of the cell typically comprises low-carbon steel; it bears on at least one of its face surfaces, but more generally on three of its outer face surfaces, a cathode band most frequently constituted of copper plate. The peripheral chamber is limited towards the outside by this enclosure and towards the top and bottom by walls of perforated metal. The tubular internal extensions are fitted to two of its inner sides, and the axes of these extensions are parallel to two of the sidewalls of the cell. The preferred material for the entirety of the internal cathode which supports the diaphragm is perforated iron or steel plate.

BRIEF DESCRIPTION OF THE DRAWINGS

FIG. 1 is a front plan view of a cathode of traversing "glove fingers" type according to this invention;

FIGS. 2, 5 and 7 are cross-sections of a portion of an electrolysis cell, more particularly shown in the perspective views of FIGS. 3, 4 and 6.

FIGS. 3, 4 and 6 are perspective views of a portion of apparatus as depicted in FIGS. 2, 5 and 7;

FIG. 8 is a side view of the outer sidewall of an electrolysis cell consistent herewith, provided on one side thereof with a cathode band; and FIGS. 9 and 10 illustrate two modified embodiments of the cathode band depicted in FIG. 8 as viewed from above.

DETAILED DESCRIPTION OF THE INVENTION

Figure 4:
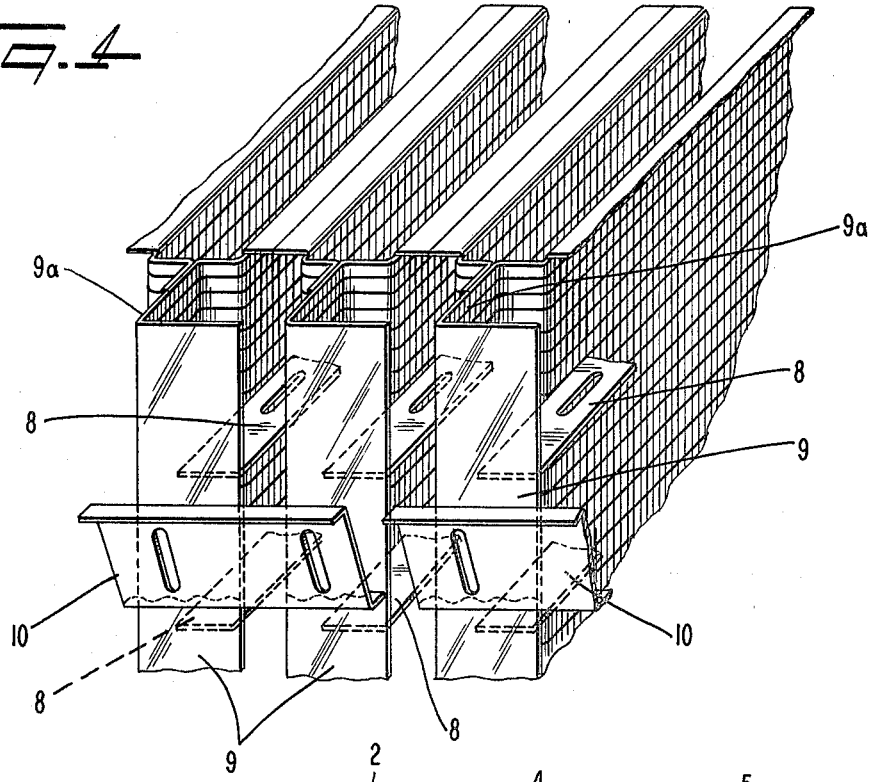

More particularly according to this invention, the strengthening elements thus comprise, within the fingers or lateral extensions, several plates separated by a distance dependent upon the rigidity of the material employed for fabrication of the internal cathode. Wholly by way of illustration, there are recommended a number of horizontal flat elements such that the distance between two flat elements represents from 5 to 15% of the total distance between the lower and upper ends of the cathode. Of course, such recommendation is predicated upon a uniform distribution of the flat elements, but the distance between any two successive flat elements can be varied, for example, by ±20%, without departing from the ambit of the invention. Same are spot-welded to the walls of the internal cathode and are welded at their extreme ends, or at one of such ends, depending on whether traversing or non-traversing fingers are involved, to flat elements in a vertical position. The various modified arrangements of these vertical flat elements will be more fully explained below.

As will also be more fully described hereinbelow, the joining of such vertical flat elements to the wall of the cell can be made by welding said flat elements to the flanges, which are themselves fixedly secured to the upper and lower regions of the vertical enclosure and are intended in one case for receiving the cover and in the other case for resting upon the bottom of the cell, or, preferably, this joint is made by S-shaped or Z-shaped iron or steel plates which are such that they have a certain flexibility and are joined to the wall of the cell, approximately at the level of the cathode band.

The thicknesses of the flat elements are selected according to the current intensity which passes through the cell and according to the nature of the metals used, so as not to have a substantial resistance and give rise to energy losses by Joule effect.

The thickness of the elements for joining to the cell wall is on the order of 3 to 6 mm.

To permit free circulation of the electrolyte, it is necessary for the various strengthening elements to be provided with perforations; the proportion of the recessed surface areas relative to the total surface area of these elements is preferably from 10 to 30%. The vertical flat elements can also be made from perforated metal of the same type as that of the internal cathode.

The cathode band, typically fabricated from copper, the cross-section and shape of which are such that, as is well known to the chlorine art, substantial current losses by the Joule effect are avoided while at the same time a homogeneous distribution of the current is assisted, can be produced and fitted to the cell in various fashions, which will be illustrated below. Preferably, the vertical walls of the cell or portions of these walls are secured to the cathode band or elements thereof by explosive bonding.

Now referring specifically to the Figures of Drawing, in FIG. 1 is shown the vertical sidewalls 1 of an electrolysis cell, which are provided with flanges 2 at the upper and lower vertical extremeties thereof; a cathode band 3 is secured to these sidewalls. Inside the cell, a peripheral chamber 4, the upper portion of which being shown, limits, together with the lateral internal extensions or fingers 5, with the upper portion again being shown, the cathode compartment of the cell. Between the fingers 5 appear the empty or free spaces 6 in which the anodes fixed to the bottom of the cell are housed, during the assembly of the cell, these anodes not being here shown. The orifice 7 in communicating relationship with the peripheral chamber 4 permits the discharge of the gases formed at the cathode.

The walls of the cathode fingers 5 and of the peripheral chamber 4 are also shown in FIG. 2. FIG. 2 shows the flat metal elements 8 fixed in a horizontal position to the cathode fingers and, inside the latter, by the welding spots represented by black dots in this figure, and, at their ends, to the vertical flat element 9, which is itself joined to the cell wall 1 by the flexible assembly or bellows 10. The elements of the internal cathode are shown in FIG. 3. It will be noted that the horizontal flat elements 8 are welded at their ends to the vertical flat elements 9, which are arranged opposite the cathode compartments and the corresponding fingers 5.

Figure 5:
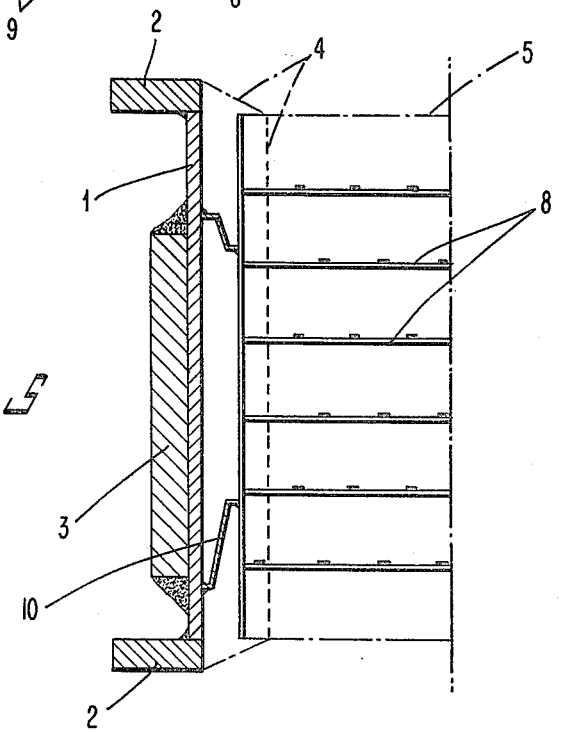

An analogous embodiment is shown in FIGS. 4 and 5. However, the vertical flat elements are formed by folds in the perforated metal, turned back at 9*a*, of the internal cathode; solid metal angle-bars could also be used instead of the turned-back perforated metal; the horizontal flat elements supported by the vertical flat elements are mainly opposite the space located between the cathode fingers.

Figure 6:
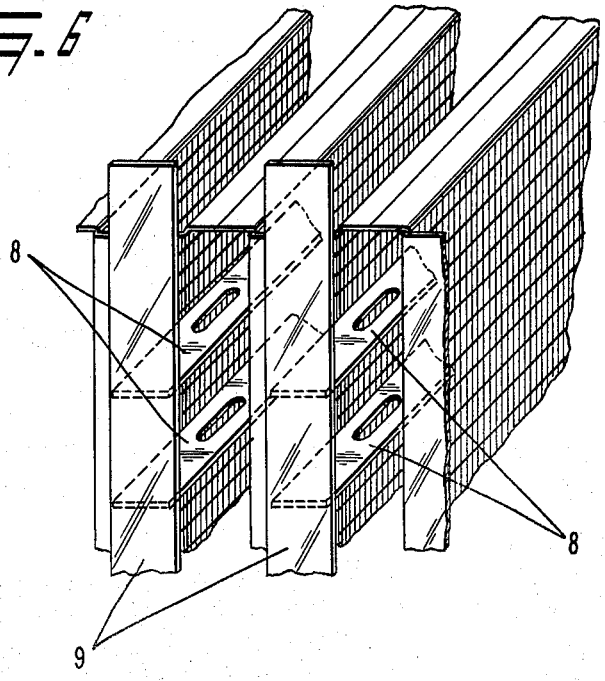
Figure 7:
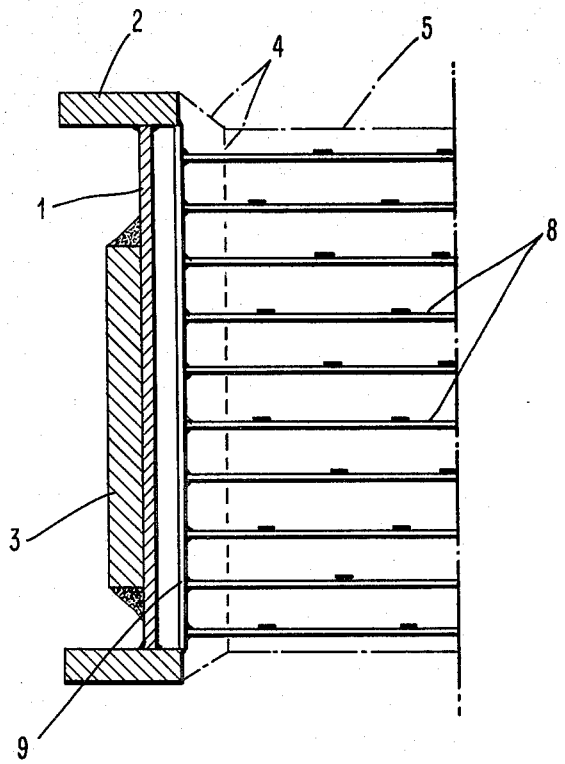

In the embodiment according to FIGS. 6 and 7, a cathode is shown, the internal portion of which is more rigid than previously; the vertical flat elements 9 are butt-welded to the flanges 2, which overlap towards the inside of the cell.

FIG. 8 depicts a side view of a cell wall 1 provided with a cathode band 3. A portion of the wall is applied to the cathode band 3, preferably by explosive bonding and this portion is then welded to the complementary parts of such wall, along the line 1*b*. This cathode band can consist of three planar parts, as shown in FIG. 9, or of two right-angled parts, as shown in FIG. 10. It can also be in two parts, of which one is right-angled and the other planar, or can be in a single part in the shape of a horseshoe.

The vertical walls of the cell are then welded to one another as shown in FIGS. 9 or 10. In both cases, the welds are made between metals of the same type. To avoid problems due to expansion, it can be useful to apply a steel plate to the band at the points where such band is not in contact with the walls. In FIG. 10, the extensions 1*d* of the sides of the cell are applied in this way, but independent plates can also be used.

The internal portion of the cathode is advantageously constructed by first welding the horizontal flat elements internally to the cathode fingers, and then by securing such horizontal flat elements to the vertical flat elements; the flexible joining elements are affixed to the internal wall of the cell, the internal part is then introduced inside the housing, the vertical flat elements are then welded to the flexible elements and, finally, the lower and upper walls of the peripheral chamber are welded to the flanges or the top of the vertical walls of the cell. The flexibility of the joining elements between the strengthening elements and the vertical wall permits rapid and precise adjustment of the assembly.

If necessary, the internal portion of the cathode can be separated from the housing; the operations are then the reverse of the above as follows: first cutting the peripheral chamber 4 adjacent the flange 2 and then cutting welds between the vertical flat elements and the flexible joints.

In order to further illustrate the present invention and the advantages thereof, the following specific examples are given, it being understood that same are intended only as illustrative and in nowise limitative.

COMPARATIVE EXAMPLE

A cell having a height of 760 mm, a length of 1,800 mm and a width of 1,600 mm, the vertical sidewalls of which being fabricated from 10 mm thick steel, included a copper cathode band, having a thickness of 39 mm and a width of 460 mm, extending about three of its vertical sidewalls; the base and the cover of the cell were fabricated from polyester. This cell contained an internal cathode comprised of a structure referred to in the art as being in the form of traversing glove fingers. These fingers were strengthened by means of a corrugated plate-metal stiffener welded to the aforesaid housing. These fingers, of which there were 20, were formed from a 2.5 mm thick, perforated iron plate, the orifices of which having a diameter of 3 mm and the same being 5 mm apart. The amount of surface area corresponding to the holes was 32%. The fingers themselves had a total thickness of 22 mm and were separated from one another by a space of 57 mm, in which the anodes were housed, the said anodes consisting of titanium mesh covered with platinum alloy and having an average thickness of 37 mm. The amount of the surface area of the mesh corresponding to the open holes was 21%±5%.

The electrolysis of a solution of sodium chloride containing 300 g/liter was carried out in this cell, at a current density of 25 A/dm$^2$. The potential difference recorded, after stabilization of the cell, was 35 mV between the end and the middle of a finger and 90 mV between the end of the fingers and the housing, namely, a total potential drop of 125 mV.

EXAMPLE ACCORDING TO THE INVENTION

A cell identical to that above described contained a cathode of analagous shape, consisting of a 2.5 mm thick perforated iron plate, the holes or orifice of which having a diameter of 3 mm and being 5 mm apart. The amount of the surface area of the perforated metal plate corresponding to the open holes was 32%. The fingers of this cathode were strengthened by means of 4 mm thick, horizontal flat iron plates to the extent of 6 flat elements per finger. These flat elements were perforated over their entire length (perforation diameter: 10 mm, amount of surface area corresponding to open holes: 15%) and chamfered at their edges to enable them to be welded to the perforated plate forming the cathode. Furthermore, same were welded, at both ends of the fingers, to vertical flat elements (reference numeral 9 in FIG. 3), which were themselves joined to the wall of the cell by means of the elements 10 (FIGS. 2 and 3). This cell was used for the electrolysis of a solution of sodium chloride containing 300 g/liter, as in the above comparative example. The average potential drop after stabilization was 40 mV between the end and the middle of a finger and 50 mV between the fingers and the housing, namely, a total potential drop of 90 mV; no appreciable variation was observed either in the several hours immediately following the start-up of the cell, or after an operating time of 30 months.

While the invention has been described in terms of various preferred embodiments, the skilled artisan will appreciate that various modifications, substitutions, omissions, and changes may be made without departing from the spirit thereof. Accordingly, it is intended that the scope of the present invention be limited solely by the scope of the following claims.

What is claimed is:

1. An electrolytic cell comprising a vertical housing enclosure of electrically conducting metal, said enclosure confining a peripheral chamber in communicating relationship with a cathode assembly comprising a plurality of lateral internal vertical extensions substantially rectangular in cross-section, said extensions being comprised of perforated metal and extending within the cell, said chamber and the said extensions being strengthened by a plurality of flat metal reinforcing elements substantially rectangular in dimension and arranged horizontally and extending between said extensions and secured to vertical flat elements disposed within the peripheral chamber, and said vertical flat elements themselves being fixedly secured to the vertical enclosure comprising the cell.

2. The electrolytic cell as defined by claim 1, wherein said horizontal flat elements are perforated.

3. The electrolytic cell as defined by claim 2, wherein the amount of surface area of the perforated horizontal flat elements corresponding to the open holes ranges from 10 to 30%.

4. The electrolytic cell as defined by claim 1, wherein the horizontal flat elements are substantially uniformly distributed therein.

5. The electrolytic cell as defined by claim 4, wherein the number of horizontal flat elements is such that the distance between two successive such flat elements ranges from 5 to 15% of the total distance between the lower and upper end extremeties.

6. The electrolytic cell as defined by claim 1, wherein said vertical flat elements are at least partially disposed opposite the lateral internal extensions of the cell, and with the same being butt-welded to the horizontal flat elements.

7. The electrolytic cell as defined by claim 1, wherein the vertical flat elements are disposed at least partially opposite the interspace extending between the lateral internal extensions, and said horizontal flat elements being welded to the sides of the said vertical flat elements.

8. The electrolytic cell as defined by claim 1, wherein the joints between the vertical flat elements and the vertical cell housing are comprised of flexible metal.

9. The electrolytic cell as defined by claim 1, wherein the joints between the vertical flat elements and the vertical cell housing are substantially opposite a cathode band member, said band itself being disposed and secured without the vertical cell housing.

10. The electrolytic cell as defined by claim 1, wherein the vertical flat elements are welded at their respective ends to the upper and lower edge extremeties of the vertical cell housing, to which housing a cathode band member is securedly affixed.

* * * * *